US007144477B2

(12) United States Patent
Gleason, Jr.

(10) Patent No.: US 7,144,477 B2
(45) Date of Patent: Dec. 5, 2006

(54) WEAR INDICATOR FOR SEAL STRIP IN A SUCTION BOX OF A PAPER MACHINE

(75) Inventor: James Gleason, Jr., Downeville, LA (US)

(73) Assignee: Voith Paper Patent GmbH, Heidenheim (DE)

( * ) Notice: Subject to any disclaimer, the term of this patent is extended or adjusted under 35 U.S.C. 154(b) by 49 days.

(21) Appl. No.: 10/736,441

(22) Filed: Dec. 15, 2003

(65) Prior Publication Data

US 2005/0126732 A1 Jun. 16, 2005

(51) Int. Cl.
*D21F 3/10* (2006.01)
*D21F 11/00* (2006.01)

(52) U.S. Cl. ..... 162/198; 162/263; 162/363; 162/272; 162/371; 162/199; 277/321

(58) Field of Classification Search ..... 162/363, 162/371, 374, 369, 272, 263, 198, 199, 217; 277/317–321
See application file for complete search history.

(56) References Cited

U.S. PATENT DOCUMENTS 3,591,944 A * 7/1971 Wilcox ..... 53/408
4,497,493 A * 2/1985 Sall et al. ..... 277/306
4,714,523 A * 12/1987 Sawyer et al. ..... 162/371
4,915,787 A 4/1990 Branyon et al. ..... 162/199
5,540,448 A * 7/1996 Heinzen ..... 277/321
5,746,891 A 5/1998 Withers ..... 162/371
6,003,872 A 12/1999 Nord ..... 277/317
6,279,400 B1 * 8/2001 Johnson et al. ..... 73/655
6,345,825 B1 * 2/2002 Guth et al. ..... 277/317
6,436,241 B1 8/2002 Persson et al. ..... 162/371
6,595,523 B1 * 7/2003 Heinzen ..... 277/321
6,626,436 B1 * 9/2003 Pecht et al. ..... 277/317
2004/0168603 A1 * 9/2004 Boga et al. ..... 101/494
2005/0126732 A1 * 6/2005 Gleason, Jr. ..... 162/198

FOREIGN PATENT DOCUMENTS

WO WO 9518363 A1 * 7/1995
WO WO 9804776 A2 * 2/1998
WO WO 9848105 A1 * 10/1998

* cited by examiner

*Primary Examiner*—José A. Fortuna
(74) *Attorney, Agent, or Firm*—Taylor & Aust, P.C.

(57) ABSTRACT

A suction roll assembly includes a suction roll having a perforated shell, and a suction box positioned within the suction roll. The suction box includes a holder, a seal strip adjacent the shell and carried by the holder, at least one target carried by the seal strip, and at least one sensor positioned in association with at least one target. Each sensor provides an output signal indicative of a position of at least one corresponding target.

32 Claims, 1 Drawing Sheet

WEAR INDICATOR FOR SEAL STRIP IN A SUCTION BOX OF A PAPER MACHINE

BACKGROUND OF THE INVENTION

1. Field of the Invention

The present invention relates to paper machines, and, more particularly, to wear indicators for seal strips used in a suction box.

2. Description of the Related Art

Paper machines generally include a wet end and dry end of the machine. The wet end of the machine generally can be broken down into further components, such as the head box, forming section, press section, etc. Likewise, the dry end of the machine can be broken down into further components including a dryer section, winder, etc. The wet end of the machine typically includes a number of suction roll assemblies. A suction roll assembly typically includes a suction roll and suction box placed within the suction roll. The suction roll includes a perforated cylindrical shell that is rotatably supported together with the stationary suction box disposed internally thereof and connected with a source of vacuum. The suction box includes a slot like structure along one side thereof and seal strips along each side of the slot for engagement with the inside diameter of the rotating suction roll in order to provide a sealing engagement between the suction box and the inside diameter of the suction roll, so that a vacuum pressure is induced on the vacuum box in communication with the inside diameter of the suction roll to remove water which passes through the roll.

A seal strip assembly, as described above, typically includes a slot or groove along an outer edge facing the inside diameter of the suction roll which receives the seal strips therein. The seal strips are slidably moveable within the slot toward and away from the inside diameter of the suction roll. A loading tube is disposed between the bottom edge of the seal strip and the bottom edge of the slot to pneumatically or hydraulically bias the seal strip into sealing engagement with the inside diameter of the suction roll. Due to frictional contact between the seal strips and the suction roll, wear occurs on the seal strips and the inside diameter of the suction roll, resulting in a reduced life expectancy for the seal strips. In view of the necessity to shut the machine down while the seal strips are being replaced, the life expectancy of the seal strips is an important criteria of the paper machine.

It is known to provide a seal strip assembly with a sensor arrangement for remotely determining the wear state of the seal strip without having to shut down the paper machine and remove the suction roll and suction box. For example, U.S. Pat. No. 6,436,241 (Persson, et al.) discloses a seal strip assembly with an electrical indicator providing a remote indication of the wear state of the seal strip. The seal strip structure is modified to incorporate a sensor having an electrical coil configuration which detects the distance between the sensor and the inside diameter of the suction roll. This type of sensor arrangement is bulky and therefore requires large seal strips to accommodate the sensor. Moreover, modifying the seal strip affects the structural integrity of the seal strip and may result in early wear and/or failure. Further, providing an active sensor within the seal strip makes it difficult to feed the electrical conductors to an end of the suction roll. Thus, this type of wear state sensor arrangement is expensive, cumbersome, lacks accuracy, and detrimentally affects the structural properties of the seal strip.

What is needed in the art is a wear indicator for a seal strip which is accurate, less expensive, and allows for wear state determination without removal of the suction box.

SUMMARY OF THE INVENTION

The present invention provides a wear indicator for a suction roll assembly, including a target which moves with the seal strip and a sensor which is connected to a fixed structure.

The invention comprises, in one form thereof, a suction roll assembly including a suction roll having a perforated shell, and a suction box positioned within the suction roll. The suction box includes a holder, a seal strip adjacent the shell and carried by the holder, at least one target carried by the seal strip, and at least one sensor positioned in association with at least one target. Each sensor provides an output signal indicative of a position of at least one corresponding target.

An advantage of the present invention is that the sensor is coupled with a fixed surface, thereby simplifying construction and providing a more accurate indication of the wear state of the seal strip.

Another advantage is that the target sensed by the sensor may be of multiple different types and configurations.

Yet another advantage is that the wear state of the seal strip may be determined without removing the suction roll or suction box.

A further advantage is that the wear state of a seal strip may be determined using a portable or remote (fixed) monitoring circuit.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
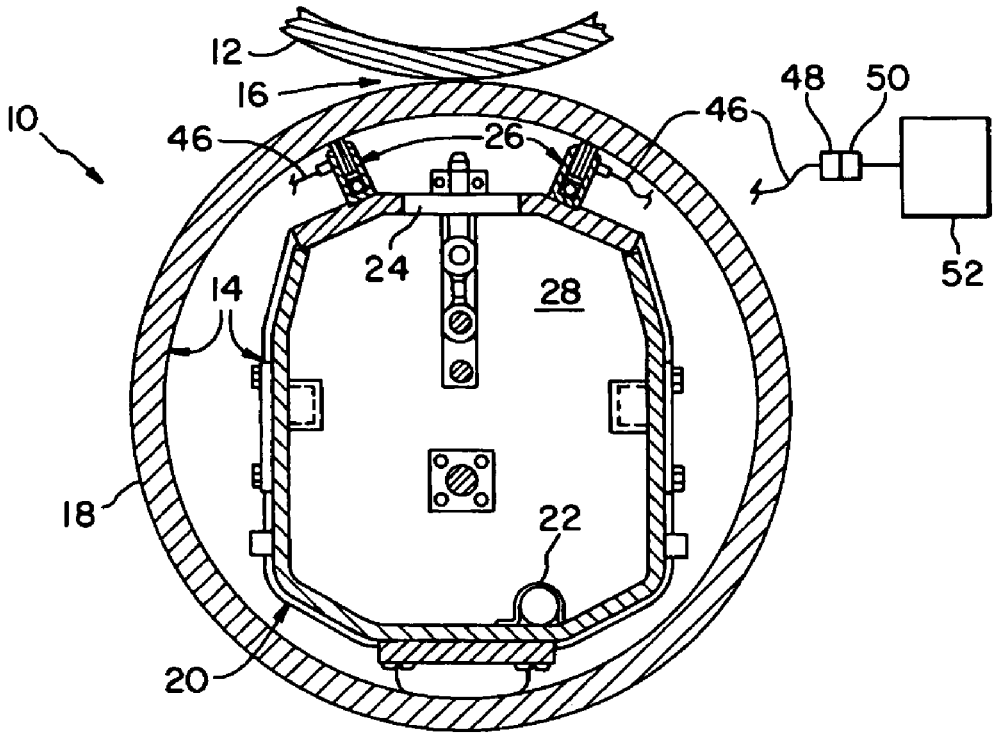
FIG. 1 is an end, sectional view of an embodiment of a paper machine of the present invention.

Referring now to the drawings, there is shown an embodiment of a paper machine 10 of the present invention, including press roll 12 and suction roll assembly 14 at the wet end of the paper machine. Paper machine 10 typically includes other components (not shown), such as a head box, wire section, forming section, drying section, etc. Press roll 12 and suction roll assembly 14 define a nip 16 therebetween, through which a fiber web (not shown) may pass. Press roll 12 and/or suction roll assembly 14 may also carry a belt, felt and/or wire (not shown) for transporting the fiber web through nip 16.

Suction roll assembly 14 generally includes a suction roll 18 and a suction box 20. Suction roll 18 has a foraminous (i.e., perforated) shell through which liquid may pass. The types and sizes of perforations may vary from one application to another, and therefore are not shown as a conventional feature in FIG. 1 for simplicity sake.

Suction box 20 is stationarily positioned within suction roll 18 and is used to remove liquid that is pressed and drawn from the fiber web traveling through nip 16. Suction box 20 includes an outlet 22 through which the liquid is removed for subsequent discarding or reuse.

At the top of suction box 20 is an opening 24 through which the liquid removed from the fiber web passes. Opening 24 is generally in the form of a slot extending much of the length of suction box 20 (in the direction perpendicular to FIG. 1). Positioned along each longitudinal edge of opening 24 are a pair of seal strip assemblies 26. Each seal strip assembly 26 extends beyond suction box 20 and seals against the inside diameter of foraminous suction roll 18. A vacuum source (not shown) applies a vacuum to outlet 22, which in turn creates a region of vacuum pressure 28 within suction box 20, including the area between seal strip assemblies 26.

Figure 2:
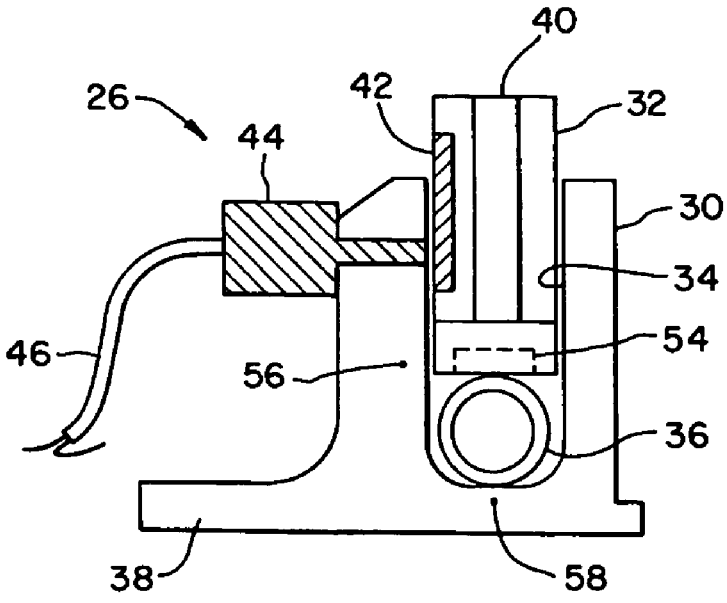
FIG. 2 is an end view of a seal strip assembly shown in FIG. 1.

Each seal strip assembly 26, as shown more particularly in FIG. 2, includes holder 30 and a seal strip 32 adjacent the inside diameter of suction roll 18. Holder 30 includes an elongated slot 34 in which seal strip 32 is disposed. A pneumatic loading tube 36 biases seal strip 32 against the inside diameter of suction roll 18.

Holder 30 may have any suitable slot-shaped configuration for mounting to suction box 20 and carrying seal strip 32. In the embodiment shown, holder 30 includes a mounting flange 38 for coupling with suction box 20 using suitable fasteners, but may be differently configured depending upon the application.

Seal strip 32 typically is formed from a hard rubber or plastic material with suitable rigidity, sealing and reduced frictional properties. Distal end 40 of seal strip 32 is biased against the inside diameter of suction roll 18 using load tube 36, and conforms to the inside diameter of suction roll 18 during use.

According to an aspect of the present invention, suction roll assembly 14 also includes an electronic wear indicator which provides an electronic indication of the wear state of seal strip 32 without removal of suction roll 18 or suction box 20. Heretofore, an attempt has been made to modify the structure of seal strip 32 to carry a sensor which senses the distance to the inside diameter of the suction roll, and therefore the corresponding distance to the distal end of the seal strip. However, modifying the seal strip affects the structural integrity of the seal strip, and is expensive and unreliable.

In contrast, the present invention places only a suitable target on seal strip 32. The actual sensor is carried by a fixed structure (e.g., holder 30) and therefore accuracy is improved.

More particularly, seal strip 32 carries a metal target 42 along one side thereof. In the embodiment shown, multiple targets 42 are spaced along the length of seal strip 32. The actual shape and/or number of targets 42 may vary from one application to another.

A sensor 44 in the form of a proximity sensor provides an output signal over electrical conductor 46 representing a position of target 42. Holder 30 includes an opening through which a portion of sensor 44 extends to provide a more accurate indication of the position of target 42. Electrical conductor 46 extends to an end of suction roll 18 and terminates at a plug-in connector 48 located outside suction roll 18. Plug-in connector 48 may be coupled with a mating plug-in connector 50, which in turn is coupled with a monitoring circuit 52. In the embodiment shown, monitoring circuit 52 is a portable monitoring circuit which a user carries and selectively plugs into individual plug-in connectors 48 to determine the wear state of a seal strip 32 of interest. Monitoring circuit 52 includes suitable electrical hardware, software and/or firmware for processing the output signals received from sensors 44. The actual configuration of monitoring circuit 52 is within the knowledge of those skilled in the art, and therefore is not described further herein.

In the embodiment of seal strip assembly 26 shown in FIG. 2, target 42 is positioned along a side of seal strip 32 and proximity sensor 44 is carried by holder 30. However, as indicated above, the actual location of target 42 and sensor 44 may vary. For example, seal strip 32 may be configured carrying one or more targets along the bottom edge thereof, as indicated by phantom line 54 shown in FIG. 2. Configured as such, sensor 44 may be carried by holder 30 near locations 56 or 58 as shown in FIG. 2. Holder 30 can be modified at these locations 56 and 58 to accommodate a suitable sensor 44, such as by forming an opening therethrough similar to that already shown in FIG. 2.

Similarly, the type of target and sensor may vary depending upon the application. For example, target 42 may be configured as an optical target and sensor 44 may be configured as an optical sensor. As a further example, seal strip 32 can be configured with a mechanical arm extending therefrom, such as at the longitudinal end of seal strip 32. The mechanical arm can be sensed by or used to actuate an electronic indicator corresponding to the wear state of seal strip 32. Target 44 may also be configured as a strip, disc, rod, etc. at one or multiple locations along seal strip 32 depending upon the application. Regardless of the type of sensor or target utilized, the number and/or configuration of the target/sensor combination may vary as long as an output signal is provided corresponding to the wear state of seal strip 32.

As is apparent from the foregoing description, one advantage is that the target is carried by seal strip 32 and moves as the wear state progresses. Sensor 44 remains at a fixed location and provides an output signal to determine the wear state of seal strip 32 as target 42 moves slightly over time.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A paper machine, comprising:

a press roll; and a suction roll assembly positioned in opposition to and defining a nip with said press roll, said suction roll assembly including:

a suction roll having a perforated shell; and a suction box positioned within said suction roll, said suction box including a holder, a seal strip adjacent said shell and carried by said holder, at least one target carried by said seal strip, and at least one sensor not connected to said seal strip and being positioned in association with at least one corresponding said target, each said sensor providing an output signal indicative of a position of said at least one corresponding target relative to said holder.

2. The paper machine of claim 1, wherein each said target is one of a metallic target, an optical target, and a mechanical target.

3. The paper machine of claim 2, wherein each said target is a metal target, and each said sensor is a proximity sensor.

4. The paper machine of claim 3, wherein each said metal target is a magnetic metal target.

5. The paper machine of claim 1, wherein each said target is one of a strip, disc and rod shaped target.

6. The paper machine of claim 1, wherein at least one said sensor is carried by said holder.

7. The paper machine of claim 6, wherein said monitoring circuit is portable.

8. The paper machine of claim 1, further including a loading tube carried by said holder and biasing said seal strip against said suction roll shell.

9. The paper machine of claim 1, including at least one electrical plug-in connector positioned outside said suction roll, each said electrical plug-in connector coupled with a corresponding said sensor.

10. The paper machine of claim 9, further comprising a monitoring circuit connectable with said electrical plug-in connector.

11. A suction roll assembly, comprising:

a suction roll having a perforated shell; and a suction box positioned within said suction roll, said suction box including a holder, a seal strip adjacent said shell and carried by said holder, at least one target carried by said seal strip, and at least one sensor positioned apart from said seal strip and being in association with at least one corresponding said target, each said sensor providing an output signal indicative of a position of said at least one corresponding target relative to said holder.

12. The suction roll assembly of claim 11, wherein each said target is one of a metallic target, an optical target, and a mechanical target.

13. The suction roll assembly of claim 12, wherein each said target is a metal target, and each said sensor is a proximity sensor.

14. The suction roll assembly of claim 13, wherein each said metal target is a magnetic metal target.

15. The suction roll assembly of claim 11, wherein each said target is one of a strip, disc and rod shaped target.

16. The suction roll assembly of claim 11, wherein at least one said sensor is carried by said holder.

17. The suction roll assembly of claim 11, including at least one electrical plug-in connector positioned outside said suction roll, each said electrical plug-in connector coupled with a corresponding said sensor.

18. The suction roll assembly of claim 17, a monitoring circuit connectable with said electrical plug-in connector.

19. The suction roll assembly of claim 18, wherein said monitoring circuit is portable.

20. A suction box for use with a suction roll in a paper machine, said suction box comprising:

a holder;

a seal strip carried by said holder;

at least one target carried by said seal strip; and at least one sensor positioned apart from said seal strip and being in association with at least one corresponding said target, each said sensor providing an output signal indicative of a position of said at least one corresponding target relative to said holder.

21. The suction box of claim 20, wherein each said target is one of a metallic target, an optical target, and a mechanical target.

22. The suction box of claim 21, wherein each said target is a metal target, and each said sensor is a proximity sensor.

23. The suction box of claim 22, wherein each said metal target is a magnetic metal target.

24. The suction box of claim 20, wherein each said target is one of a strip, disc and rod shaped target.

25. The suction box of claim 20, wherein at least one said sensor is carried by said holder.

26. The suction box of claim 20, including at least one electrical plug-in connector positioned outside said suction roll, each said electrical plug-in connector coupled with a corresponding said sensor.

27. The suction box of claim 26, a monitoring circuit connectable with said electrical plug-in connector.

28. The suction box of claim 27, wherein said monitoring circuit is portable.

29. A method of determining a wear state of a seal strip in a suction box of a paper machine, said method comprising the steps of:

providing a seal strip carried by a holder and at least one target carried by said seal strip;

biasing said seal strip against a suction roll shell;

positioning a sensor apart from said seal strip and in association with at least one corresponding said target; and outputting a signal from said sensor indicative of a position of said at least one corresponding target relative to said holder.

30. The method of claim 29, including the steps of:

coupling said sensor with an electrical plug-in connector; and positioning said electrical plug-in connector outside said suction roll.

31. The method of claim 29, including the step of connecting a monitoring circuit with said electrical connector.

32. The method of claim 31, wherein said monitoring circuit is portable.

* * * * *